US006308695B1

(12) United States Patent
Watanabe et al.

(10) Patent No.: US 6,308,695 B1
(45) Date of Patent: Oct. 30, 2001

(54) OUTBOARD MOTOR ENGINE LAYOUT

(75) Inventors: Kazuhiko Watanabe; Yuji Hori, both of Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/383,846

(22) Filed: Aug. 26, 1999

(30) Foreign Application Priority Data

Aug. 26, 1998 (JP) ..... 10-239615

(51) Int. Cl.[7] ..... F01M 11/08
(52) U.S. Cl. ..... 123/572
(58) Field of Search ..... 123/572, 573, 123/574, 41.86, 195 R

(56) References Cited

U.S. PATENT DOCUMENTS 5,383,440 * 1/1995 Koishikawa et al. ..... 123/572
5,501,202 3/1996 Watanabe .
5,514,015 5/1996 Okazawa et al. .
5,794,602 8/1998 Kimura .
5,899,197 5/1999 Watanabe et al. .

* cited by examiner

*Primary Examiner*—Marguerite McMahon

(57) ABSTRACT

An outboard motor contains an engine. The engine is generally vertically disposed and has a cam chamber positioned on a forward-facing portion of the engine. The cam chamber is defined between a cam cover and a cylinder head assembly. A vapor separator is positioned on the cam cover and protrudes to the outside of the cam cover such that adequate clearance is maintained for a cam shaft arrangement within the cam chamber. The vapor separator has a downwardly facing lubricant outlet that returns lubricant to the cam chamber after the lubricant is separated from the crankcase ventilation gases. A fuel pump is preferably positioned so as to receive lubricant from the lubricant outlet. Moreover, a lubricant fill tube is preferably positioned at least partially higher than the lubricant outlet. In one embodiment, the fill tube is located to a side of the vapor separator while the fuel pump is located below the fill tube.

18 Claims, 9 Drawing Sheets

OUTBOARD MOTOR ENGINE LAYOUT

BACKGROUND OF THE INVENTION

1. Field of the Invention

The present invention generally relates to outboard motors. More specifically, the present invention relates to layouts of cam covers for engines of outboard motors.

2. Description of Related Art

To improve the performance of a watercraft, the associated weight and drag of a watercraft may be reduced. In regard to the outboard motor, this means reducing the motors' weight and streamlining the structure of those portions extending above a transom of the watercraft and extending into the water in which the watercraft is operating.

Accordingly, U.S. Pat. No. 5,501,202 teaches an engine layout for reducing the weight and size of an outboard motor. The layout involves positioning a vapor separator of a crankcase ventilation system on a cam cover outside of a cam chamber. A fuel pump is also positioned at about the center of the cam cover, beneath the separator, to generally balance the length of fuel travel to each of a plurality of carburetors.

SUMMARY OF THE INVENTION

The present invention improves upon such a configuration. It has been discovered that positioning an oil fill below the lubricant outlet of the vapor separator results in possible flow of lubricant from the oil fill when the oil fill cap is removed. The flow of lubricant to the outside of the cam cover may result in fouling of electrical components positioned in close proximity. Accordingly, the positioning of the oil fill below the lubricant outlet of the vapor separator has been determined to be disadvantageous.

Moreover, it has been discovered that the lubricant escaping from the vapor separator through the lubricant outlet may be used to lubricant discrete contact points between moving elements. For instance, the lubricant may be used to lubricate the moving components of the fuel pump. In the fuel pump of the present invention, the lubricant is directed to the contact point between a rocker arm and a piston of the fuel pump. In this manner, the lubricant being drained from the vapor separator is directed to difficult to lubricant elements.

Accordingly, one aspect of the present invention involves an engine for an outboard motor. The engine has a cylinder block interposed between a cylinder head and crankcase. The engine further comprises a cam cover attached to the cylinder head to enclose a cam chamber within the cylinder head. The cam chamber contains a valve operating mechanism. A lubricant vapor separator is located on the cam cover outside of the cam chamber. The separator includes an upper opening communicating with a separator chamber. The chamber is in communication with the cam chamber through at least the upper opening. The separator also includes an intermediate opening through which ventilation gases are vented for recirculation through the engine and a lower opening through which lubricant, separated from the ventilation gases, flows from the vapor chamber into the cam chamber. The cam cover further comprises an oil fill port. The oil fill port includes an aperture extending through the cam cover. At least a portion of the aperture is positioned to lie at least generally vertically as high as or higher than the lower opening of the separator.

Another aspect of the present invention involves an outboard motor comprising a cowling. An engine compartment is defined within the cowling. An engine is mounted in the engine compartment. The engine comprises a cylinder block. A crank cover is mounted to a face of the cylinder block and a crankcase is defined between the crank cover and the cylinder block. A cylinder head is mounted to a face of the cylinder block opposite the crank cover. A cam cover is connected to the cylinder head and a cam chamber is defined by the cam cover and the cylinder head. At least one cam shaft is positioned within the cam chamber. A vapor separator is positioned on the cam cover and is arranged to protrude from the cam cover generally away from the cam shaft. The engine further comprises a fuel pump positioned along the cam cover at a location generally below the vapor separator.

BRIEF DESCRIPTION OF THE DRAWINGS

These and other features, aspects and advantages of the present invention will now be described with reference to the drawings of certain presently preferred embodiments, which embodiments are intended to illustrate and not to limit the present invention, and in which figures.

DETAILED DESCRIPTION OF THE PREFERRED EMBODIMENTS OF THE INVENTION

Figure 1:
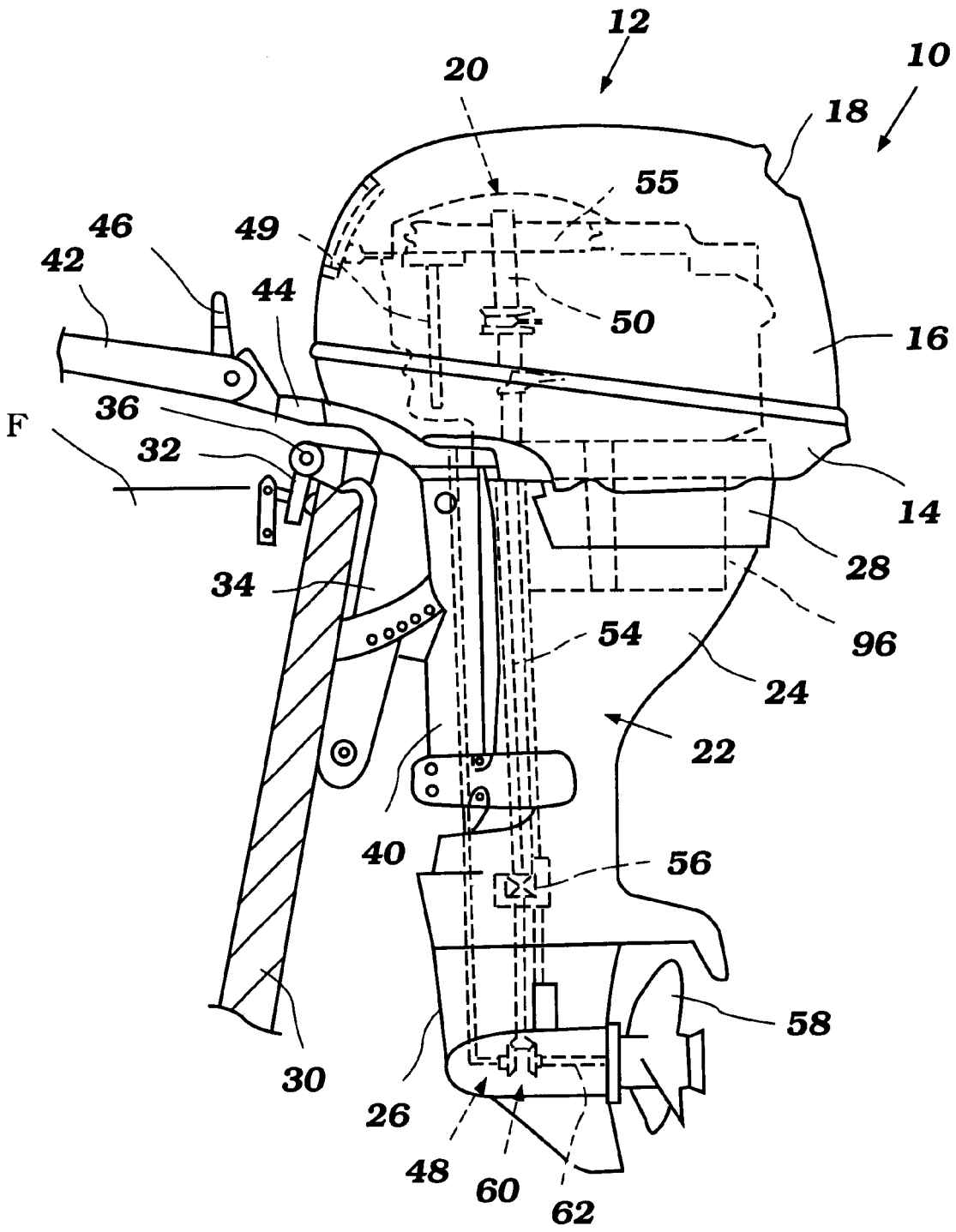
FIG. 1 is a side elevation view of an outboard motor having certain features, aspects and advantages of the present invention and having certain internal components illustrated with hidden lines and a watercraft transom illustrated in section.

With initial reference to FIG. 1, an outboard motor incorporating an internal combustion engine for powering watercraft is illustrated therein. The outboard motor, indicated generally by the reference numeral 10, advantageously is arranged and configured in accordance with certain features, aspects and advantages of the present invention. The outboard motor 10 provides an exemplary environment in which the present engine layout has particular utility; however, the present engine layout may also find utility in inboard/outboard applications.

With continued reference to FIG. 1, the illustrated outboard motor 10 generally comprises a power head 12 having a lower tray portion 14 and an upper cowling portion 16. The power head components may be manufactured of any suitable material, including, without limitation, reinforced plastics, fiberglass and metals, in any known manner. The lower tray portion 14 and the upper cowling portion 16 preferably are joined together to form a power head 12 that is substantially weatherproof and water spray resistant. For instance, a rubber seal (not shown) may be positioned in the joining region.

An air vent or air inlet area 18, which may be rearward facing, is provided in the illustrated upper cowling portion 16. As is known in the art, the vent 18 preferably includes a portion which acts as a drain for the water removed from the intake air flow by the baffle and functions as a handle for raising and lowering the outboard motor 10. Air may enter through the vent 18 for induction into an internal combustion engine 20 that is preferably arranged and encased within the power head 12. The air vent 18 preferably includes a baffling region disposed between the outside portion of the air inlet 18 and the portion of the air vent 18 that communicates with the engine compartment defined by the powerhead 12. The baffle preferably inhibits waterflow into the engine compartment. The air vent 18 may also allow heated air to be exhausted from within the power head 12 after circulation within the power head 12.

With continued reference to FIG. 1, the illustrated outboard motor 10 also includes a lower unit 22 extending downwardly from the lower tray portion 14 of the power head area 12. The illustrated lower unit 22 generally comprises an enlarged upper or drive shaft housing portion 24 and a narrower lower portion 26. Generally, the illustrated upper portion 24 is connected to the lower tray portion 14 through an apron 28, which encases the lower unit 22 and supports the lower tray portion 14.

The illustrated outboard motor is generally attached to a transom 30 of a watercraft (not shown) using a mount 32 and a bracket 34 as is well known in the art. This bracket 34 preferably enables both steering and tilt and trim such that the outboard motor 10 may be steered about a substantially vertical axis and tilted or trimmed about a substantially horizontal axis in manners well known to those skilled in the art. For instance, the bracket 34 may include a generally horizontally extending transverse tilt shaft 36. The tilt shaft 36 is preferably arranged and configured to allow tilting and trimming of the motor 10 in any known manner.

Additionally, the bracket 34 may include a swivel shaft (not shown), which is arranged to extend in a direction generally normal to the tilt shaft 36. The motor 10 is capable of being moved for steering about the swivel shaft. The illustrated swivel shaft is positioned within a rotatable tubular casing 40, which is preferably fixed to the outboard motor 10. In one embodiment, the swivel shaft is carried on bearings while in other embodiments the swivel shaft may be carried by bushings or the like. In the illustrated embodiment, the swivel shaft simply floats within the tubular casing 40.

The rotation of the tubular casing 40 relative to the swivel shaft (not shown) may be controlled using a steering handle 42 that is connected to an upper steering bracket 44 in any suitable manner. Movement of the steering handle 42 in the illustrated embodiment causes a corresponding movement in the steering bracket 44. The steering racket 44 is fixed to the tubular casing 40 and enables an operator to control movement of the motor 10 relative to the watercraft for steering. The steering handle 42 may also carry a shifting lever 46. In one embodiment, the shifting lever 46 is connected to a shiftable transmission 48, which will be discussed below.

Although not illustrated, it is understood that a conventional hydraulic tilt and trim cylinder assembly, as well as a conventional hydraulic steering cylinder assembly, could also be used with the present outboard motor 10. It is also understood that the above description of the construction of the outboard motor is generally conventional and thus further details of the steering, trim and mounting assemblies are not necessary for an understanding of the present invention.

Figure 2:
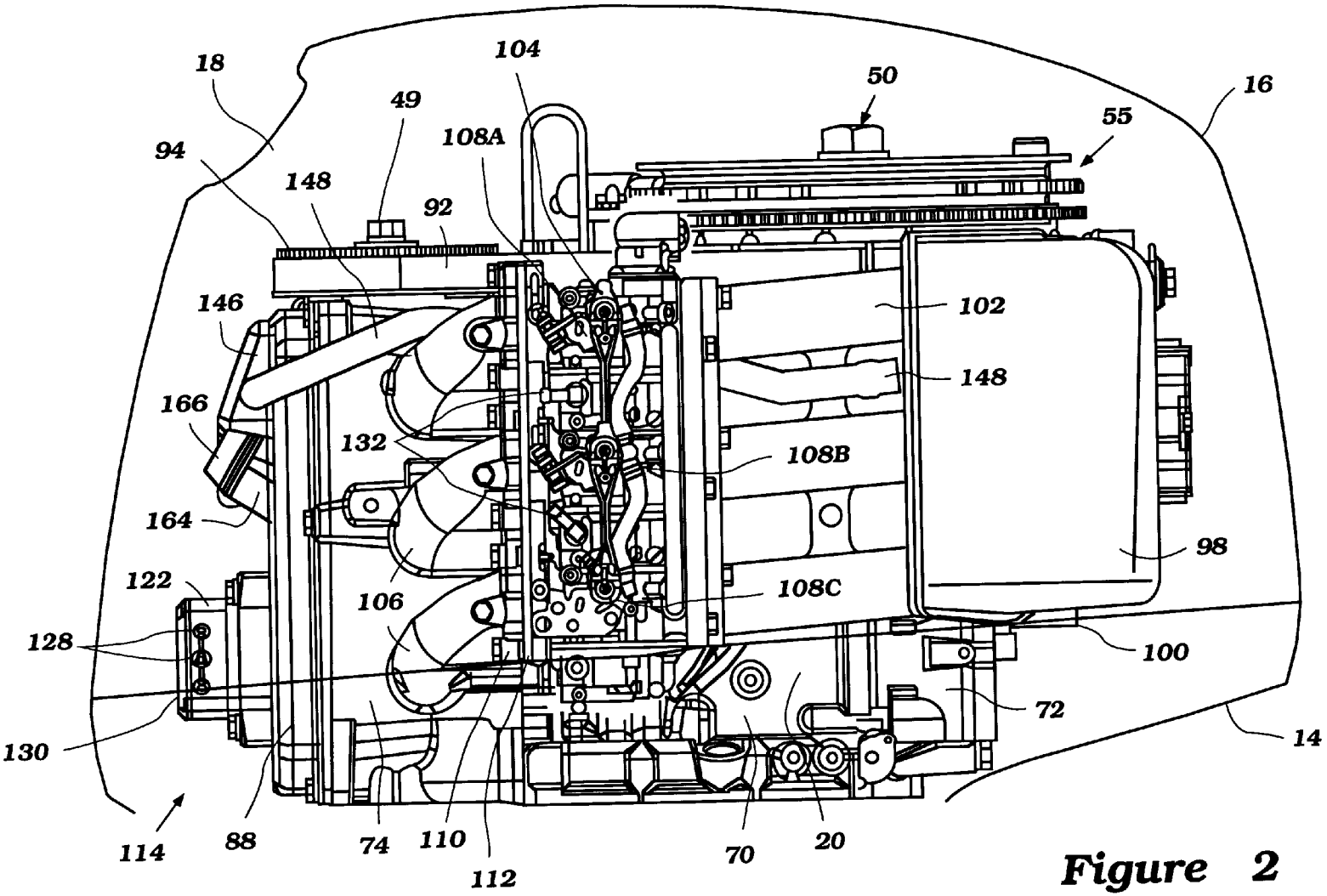
FIG. 2 is a partially sectioned side elevation view of the outboard motor of FIG. 1.

With continued reference to FIGS. 1 and 2, the engine 20 is mounted within the engine compartment defined within the power head 12. The engine 20 may be of any configuration and is preferably substantially vertically oriented such that an axis of at least one cam shaft 49 or a crankshaft 50 has an inclined or substantially vertical axis. The engine 20 may contain as few as one cylinder or more than two cylinders. In the illustrated embodiment, the engine 20 comprises two banks of three cylinders. Additionally, the engine 20 may also operate on any known operating principle. The illustrated engine 20 preferably operates on a four-cycle principle. It will be readily apparent to those of skill in the art, however, that the present engine layout may be employed with engines having other numbers of cylinders, having other cylinder orientations, and/or operating on other than a four-stroke principle.

Rotational power from the engine 20 is obtained from the output shaft 50 (i.e., crankshaft) that is driven for rotation in a manner well known to those of ordinary skill in the art. The crankshaft 50 is preferably drivingly coupled to a driveshaft 54 in any suitable manner. Accordingly, the driveshaft 54, which depends downwardly from the power head 12, is powered for rotation by the engine 20 through the crankshaft 50. As best seen in FIG. 2, a magneto generator/flywheel assembly 55 is attached to the upper end of the illustrated crankshaft 50.

The rotation of the driveshaft 54, in turn, drives both a water pump 56 and a propulsion device 58 in the illustrated embodiment. The illustrated propulsion device 58 is driven in both a forward direction and a reverse direction through the shiftable transmission 48. Preferably, the transmission is a forward, neutral, reverse type transmission. In the illustrated embodiment, this shiftable transmission generally comprises a selectable bevel gear arrangement 60. The selectable bevel gear arrangement 60 preferably couples the drive shaft 54 to a propulsion shaft 62 and the propulsion device 58. The propulsion device 58 may include any suitable propulsion device such as, for example, a propeller or a hydrodynamic jet pump. In the illustrated embodiment, the propulsion device 58 is a single propeller; however, it is understood that a counter-rotational propelling device can be used as well. These components are journaled for rotation in any suitable manner, such journaling arrangements being well known to those of ordinary skill in the art.

As best seen in FIG. 2, the engine 20 includes a cylinder block 70, which in the illustrated embodiment defines six cylinder bores (not shown) positioned three to a cylinder bank (not shown). The cylinder block can be formed by either a single member or an assembly of members; thus, as used herein, "cylinder block" means the block or block assembly that defines at least the cylinder bores. Pistons (not shown) reciprocate within the cylinder bores and connecting rods link the pistons and the crankshaft 50 together so that the reciprocal linear movement of the pistons within the cylinder bore rotates the crankshaft 50 in a known manner. A crankcase 72 is attached to the cylinder block 70 and surrounds at least a portion of the crankshaft 50. The crankshaft 50 is journaled within a crankcase chamber, which is formed by the crankcase 72 and the cylinder block 70, so as to rotate about a generally vertical axis.

On the opposite end of the cylinder block 70, a cylinder head 74 is attached to close an end of the cylinder bores. As used herein, "cylinder head" collectively means the cylinder head (formed either from a single or multiple components) that closes one or more of the cylinders, as well as the assembly which supports the valve mechanism of the engine. The cylinder head 74 generally has a conventional construction and supports a plurality of intake and exhaust valves 76, 78 (shown in FIG. 4). The cylinder head 74 also journals and partially houses at least one camshaft 49, which operates the valves 76, 78. As is generally known in the art, the intake valves 76 and the exhaust valves 78 control the flow of gases into and out of a combustion chamber 80 (shown in FIG. 6).

Figure 6:
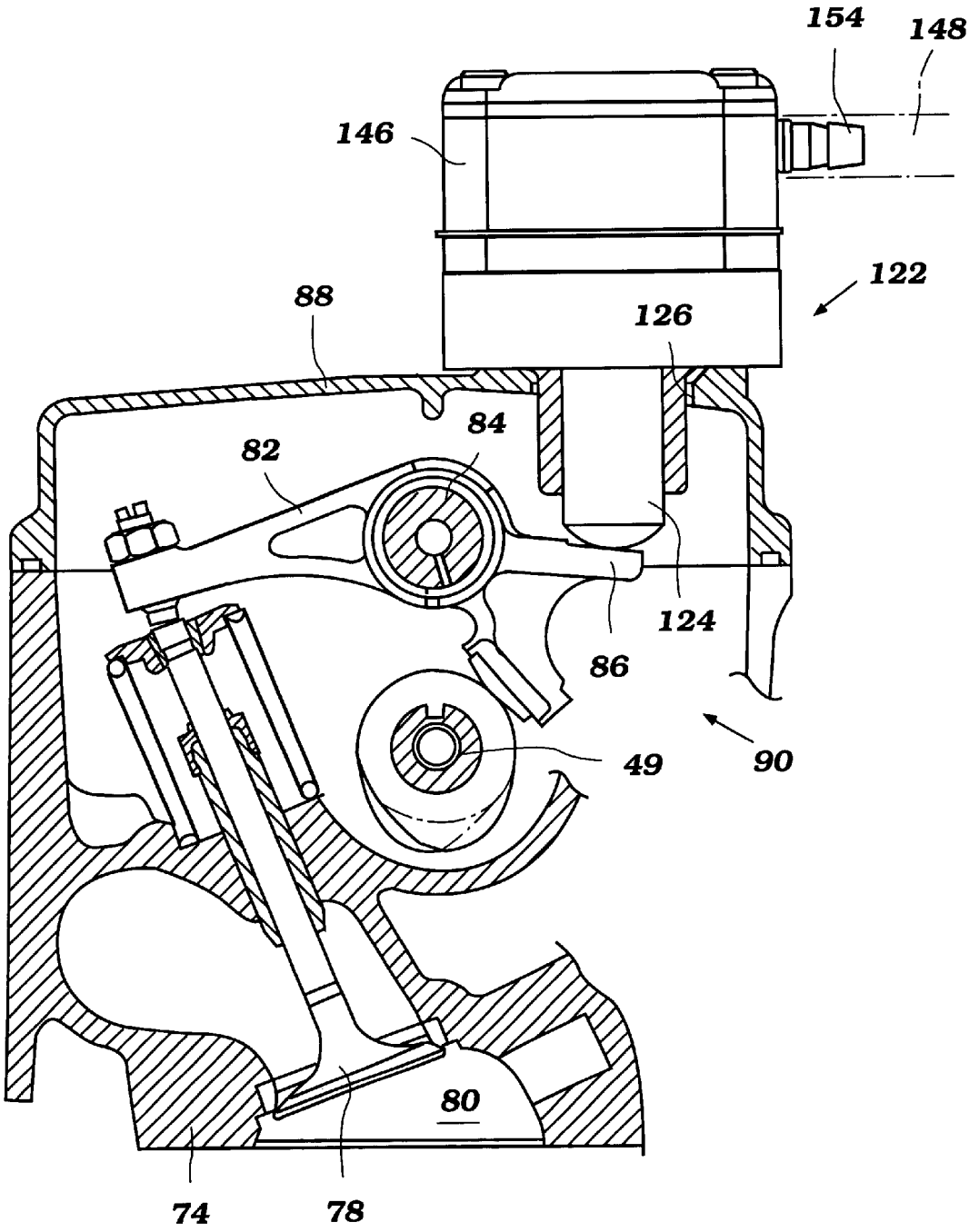
FIG. 6 is a partially sectioned view of the assembled overhead cam cover and engine of FIGS. 4 and 5.

With continued reference to FIG. 6, in the illustrated embodiment, the overhead cam shaft 59 actuates rocker arms 82 journaled about a rocker shaft 84 to operate the valves 76, 78 positioned within the cylinder head 74. It is understood, however, that a plurality of overhead cam shafts (i.e., intake and exhaust cam shafts) can operate the valves 76, 78 directly using tappets, or can be located to the sides of the cylinders and operate the valves via push rods, as known in the art. In the presently preferred arrangement, however, the rocker arms further comprise rocker arm tips 86 which extend in an opposite direction to the portions of the rocker arms which actuate the valves 76, 78. The tips 86 may be used to drive a fuel pump in manners which will be described in detail below.

Figure 4:
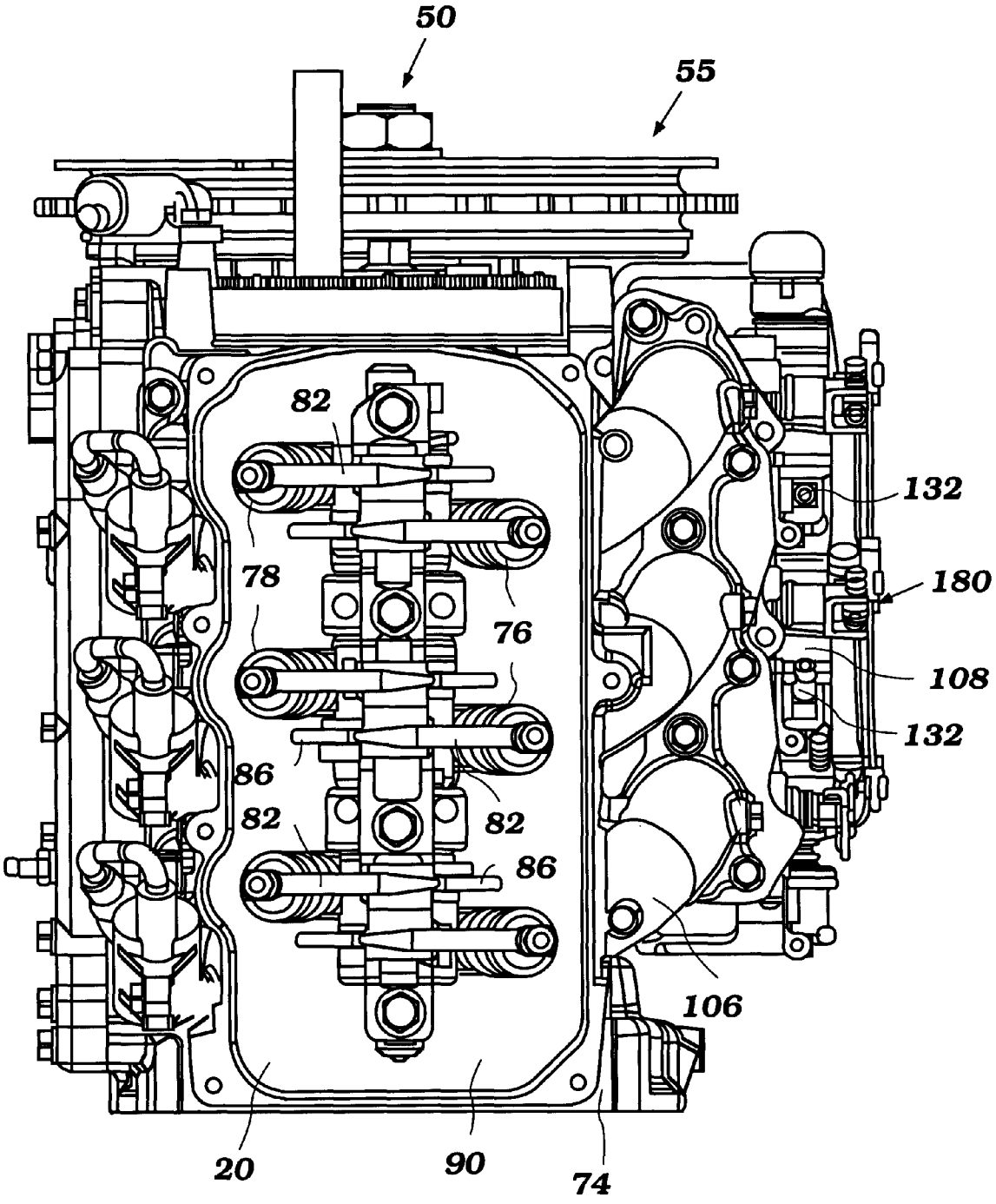
FIG. 4 a front-end view of an engine of the outboard motor of FIG. 1 with an overhead cam cover removed.

With reference now to FIGS. 2 and 4, a cam cover 88 together with a cylinder head 74 define a cam chamber 90 in which the valves 76, 78, cam shaft 49, and rocker arm shafts 82 are located. The inner side of the presently preferred cam cover 88 is illustrated in detail in FIG. 5 and will be described below. The cam cover 88 is attached by any suitable method to the cylinder head 74 on a side opposite that of the cylinder block 70.

An external toothed timing belt 92 extends between the crankshaft 50 and a pulley 94 coupled to the cam shaft 49. As known in the art, the pulley 94 has a diameter twice that of a pulley on the crankshaft 50 so that the crankshaft 50 drives the cam shaft 49 at half the rotational speed of the crankshaft 50. Preferably, an upper cover covers the external belt 92 and pulley 94, as well as the magneto-generator/wheel assembly 55.

The engine 20 also includes a conventional lubrication system which circulates lubricant through the engine 20. A lubricant pump (not shown) delivers lubricant from a lubricant pan 96 (shown in FIG. 1), which is housed in the drive shaft housing 22, through a lower gallery (not shown) to the crankcase 72. A series of conventional conduits within the crank case 72 deliver the lubricant to the bearings which journal the crankshaft 50 within the crank case 72 and cylinder block 70. An upper gallery (also not shown) delivers lubricant from the crank case 72 to a bearing (not shown) of the cam shaft 49. Once at the top of the cylinder head 74, the lubricant drains through the cam chamber 90 over the cam shaft 49, rocker arm shaft 84, and valve stems to lubricate the corresponding bearing surfaces. The lubricant then drains from the cam chamber 90 to the lubricant pan 96 (see FIG. 1).

Figure 3:
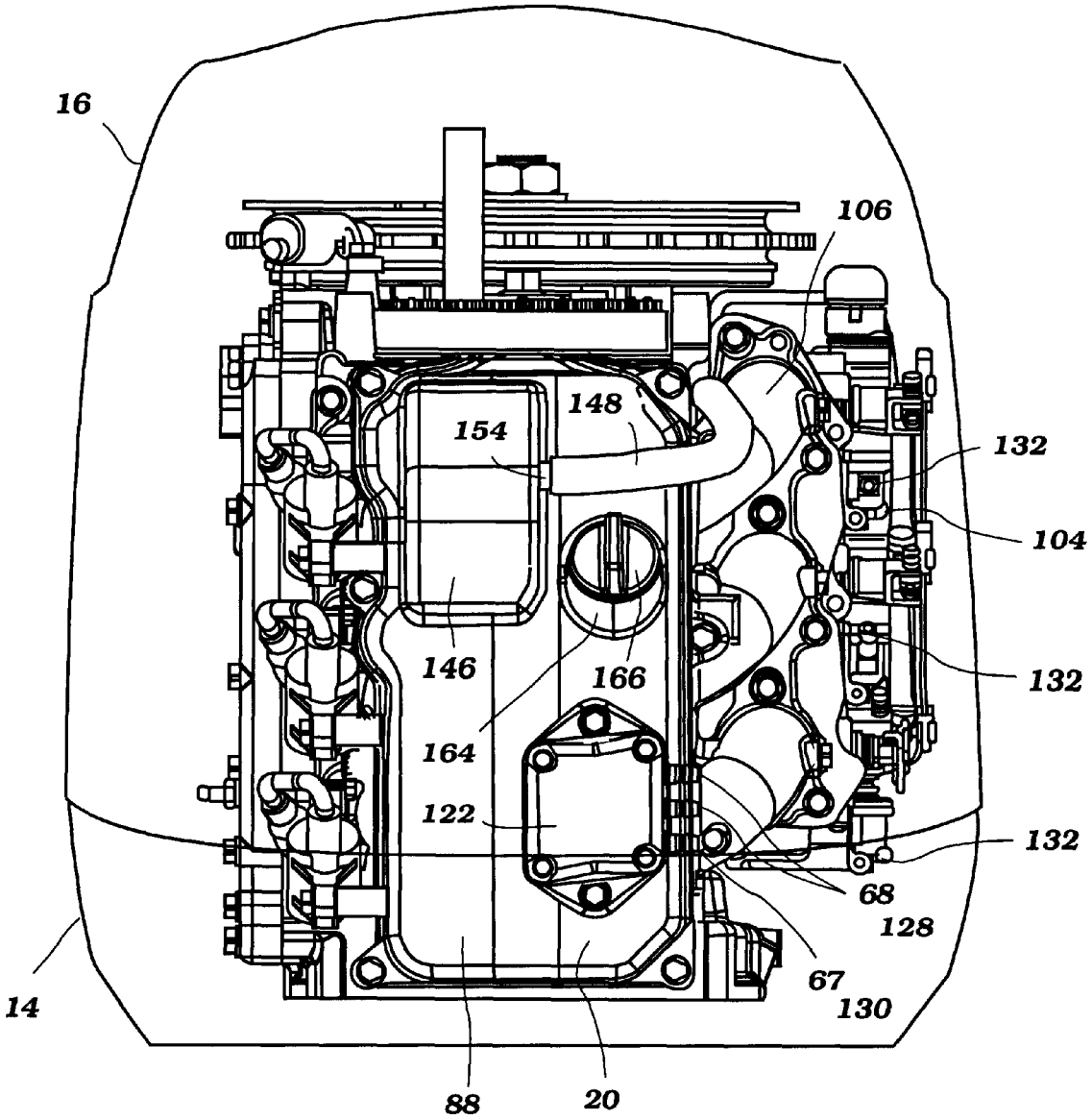
FIG. 3 is a partially sectioned front-end view of the outboard motor of FIG. 1.

With reference again to FIGS. 2 and 3, the engine 20 also includes an induction system. The induction system includes an intake silencer 98 having a downwardly facing air inlet 100, which is disposed to the front of the power head 12 and on one side of the crankcase 72. The intake silencer 98 draws air into the engine 20 from the interior of the cowling 16 and silences the intake air charge.

A series of induction pipes 102 deliver air from the air intake silencer 98 to a plurality of charge formers 104. The lengths of the induction pipes 102 are desirably tuned with the intake silencer 100 to minimize the noise produced by the induction system, as known in the art.

The charge formers 104 produce a charge of air and fuel which is delivered to a plurality of intake pipes 106 of the cylinder head 74. Each individual intake pipe 106 communicates with an individual combustion chamber 80 of the engine 20 through the intake valve system 76. As shown in FIG. 2, the charge former 104 is interposed between the induction pipes 102 and the intake pipes 106 of the cylinder head 74.

In the illustrated embodiment, the charge formers 104 are a plurality of vertically aligned carburetors 108, each connected to an air intake pipe 106. It should be understood, however, that although the invention is described in conjunction with a carburated engine, certain facets of the invention may be employed in conjunction with other types of charge formers such as fuel injectors or the like. For ease of description, each carburetor will be designed by an A, B, or C suffix identified from the top down and the collection of carburetors shall be designated generally by the reference numeral 108, without suffix. It also should be understood that the designation A through C of the carburetors 108 mirrors upon itself from one side of the engine to the other as there are two similar banks of cylinders arranged in a V-type of configuration, as described above. The carburetors 108 may be of any known type and construction. However, each illustrated carburetor is provided with a fuel bowl (not shown) to which fuel is admitted through a float-controlled valve (not shown) so as to maintain a uniform head of fuel therein. As well known in the carburetor art, these fuel bowls are vented to the intake passage (not shown) of the carburetor 108 so as to maintain a uniform pressure balance.

The carburetors 108 are attached between the induction pipes 102 and the intake pipes 106. Each carburetor 108 serves a respective cylinder within the cylinder block 70 and thus is aligned with the corresponding intake pipe 106. Specifically, the intake pipes 106 which are integrally formed into an intake manifold of the cylinder head 74 terminate in a flange portion 110 that extends generally parallel to and in the same plane as a sealing surface of the cylinder head 74, which engages the cylinder block 70. The carburetors 108 are attached to the corresponding intake pipes 106 by means that include a common mount plate 112. The common mount plate 112 is attached to the flange portion 110 of the intake manifold in a known manner. On the opposite side of the carburetors, the carburetors 108 are attached to the outlet end of the induction pipes 102 in a known manner.

A fuel supply system 114 delivers fuel to the charge former 104. In the illustrated embodiment, the fuel supply system 114 includes a fuel pump 122. The fuel pump 122 communicates with a fuel filter so as to draw fuel through a main conduit and through the fuel filter. Thus, the pump delivers filtered fuel to the charge formers 104 for mixing with air to provide a fuel/air charge. The fuel pump 122 is preferably operated by the cam shaft 49 of the engine 20. More specifically, the fuel pump 122 is preferably actuated by one of the rocker arms 82 as shown in FIG. 6. For this purpose, as seen in FIG. 6, the fuel pump 122 has an actuating plunger 124 extending into the cam chamber 90 through the cam cover 88. Specifically, an aperture 126 formed within the cam cover 88 allows the plunger 124 to extend into the cam chamber 90 and contact the tip 86 of the rocker arm 82. As illustrated, the aperture 126 is preferably substantially closed and sealed by a portion of the fuel pump 122.

With reference again to FIG. 2, the illustrated fuel pump 122 includes a pair of upper discharge ports 128 and an intake port 130. Each discharge port 128 is at least a portion of the fuel bowl of the lowermost carburetor 128*c* and below the first (i.e., uppermost) carburetor 108*a* and its fuel bowl. In the illustrated embodiment, the lower fuel discharge 128 is disposed above the fuel bowl of the third carburetor 108*c* and below the second carburetor 108*b*. Because of this positioning, the length which the fuel must travel vertically from the fuel pump 122 to the respective carburetors 108 is shortened.

The discharge ports 128 are connected to a plurality of fuel inlet ports 132 through the use of conduits (not shown) in a manner well known to those of skill in the art. Thus, fuel flows from the fuel pump 122 to the carburetors 108 through the conduits.

With reference again to FIG. 2, the cam cover 88 is formed with a lubricant/vapor separator 146 which separates lubricant from the crankcase ventilation gases. As known in the art, combustion gases which pass through the piston rings into the crankcase (i.e., "blow-by gases") are used to ventilate the lubricant in the crankcase. The lubricant flow within the lubrication system entrains these gases which are transported from the crankcase to the cylinder head. The separator 146 is connected to the induction system via a conduit 148 so that the ventilation gases flow through the crankcase 72 and cylinder head 74 and exit the cylinder head 74 through the separator 146. The blow-by gas then flows through the conduit 148 to the air intake silencer 98 for recirculation through the engine 20 to reduce undesirable exhaust emissions.

Figure 5:
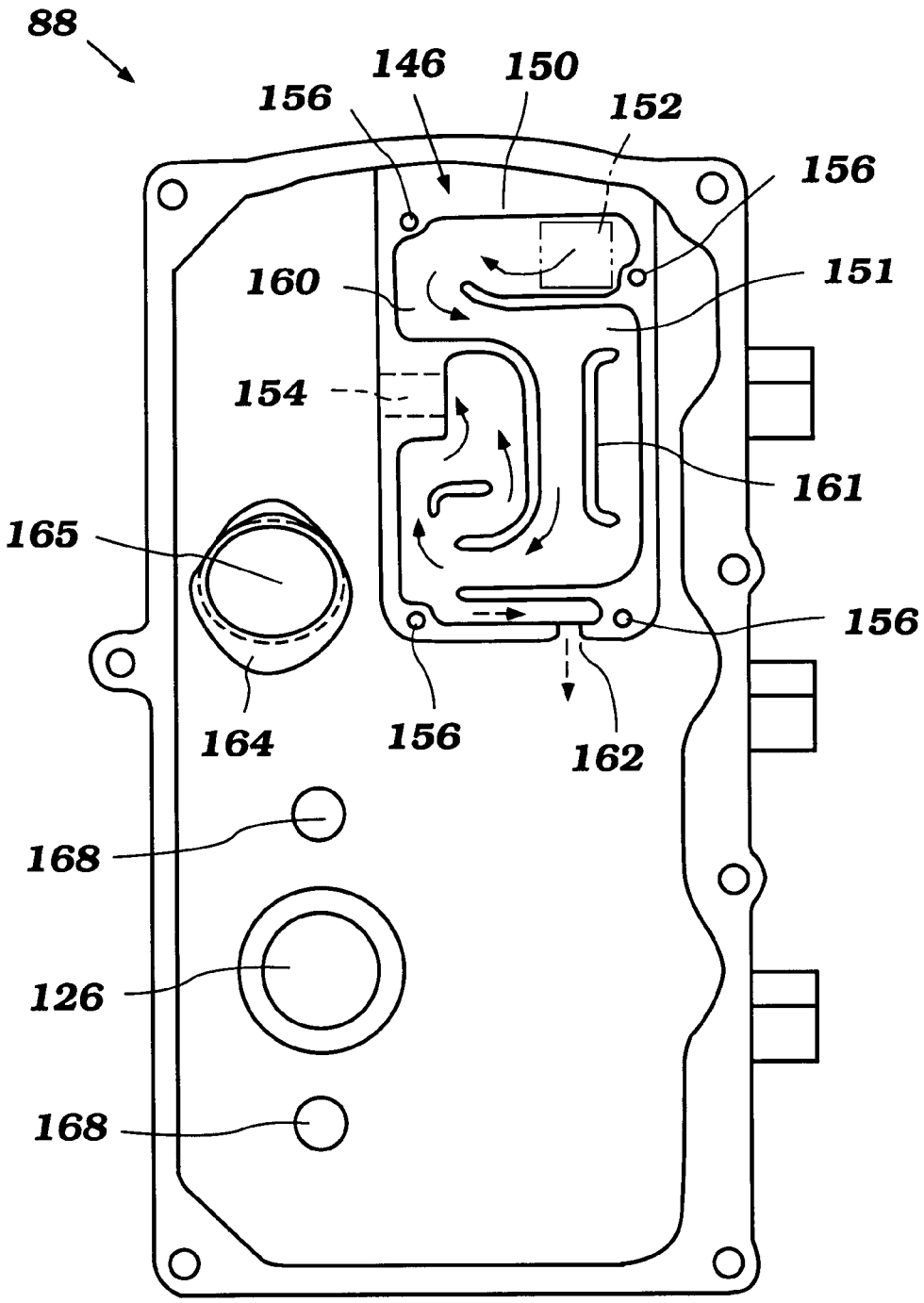
FIG. 5 is an elevation view of the overhead cam cover of the engine of FIG. 4.

As best seen in FIGS. 2 and 5, the separator 146 is formed at an upper end of the cam cover 88. The separator 146 includes a chamber case 150 which is preferably formed integrally with the cover 88 and which defines a vapor collection chamber 151 external of the cam chamber 90. More specifically, the separator 146 is desirably formed so as to lie external to the cam chamber 90. An upper edge of the chamber case 150 is sloped at its upper end to provide clearance for the top cowling 16 as it swings to open and close. An intake port 152 of the separator 146 communicates with the vapor chamber 151. An effluent port 154 also desirably communicates with the vapor chamber 151 and is desirably configured as a hose nib to receive an end of the conduit 148. The conduit 148 in turn connects the effluent port 154 to the intake silencer 98.

With continued reference to FIG. 5, a plate (not shown) completes the vapor chamber 151 and separates it from the cam chamber 90. Screws may be used to attach the plate to an inner surface of the cam cover 88 at the threaded apertures 156. The plate desirably includes an opening which corresponds to the intake port 152 such that the vapor chamber 151 is placed in communication with the cam chamber 90 within the cylinder head 74. As shown in FIG. 5, the separator 146 also includes a baffle 160 which has a labyrinth structure configured to separate lubricant from the crankcase ventilation gases as known in the art. The baffle 160 is generally comprised of a plurality of ribs 161 which define the tortuous path or labyrinth structure through which the ventilation gases must pass prior to being sucked through the effluent port 154 and into the induction system.

The separator 146 also includes a lower opening 162 through which lubricant, separated from the ventilation gases by the baffle 160, drains from the vapor chamber 151 into the cam chamber 90. The lower opening 164 is positioned below the effluent port 154 so that the separated lubricant will not inadvertently flow through the effluent port 154. In the illustrated embodiment, the effluent port is positioned approximately halfway between the uppermost located intake port 152 and the lowermost located opening 162. In this manner, the air flow must travel downward and then return upward prior to being evacuated through the effluent port 154. Also in the illustrated embodiment, the vapor separator 146 is positioned and sized such that it does not extend across the entire width of the cam cover 88. In this manner, other elements may also be positioned on the cam cover 88 at an elevation above the lowermost edge of the vapor separator 146.

With reference now to FIGS. 2 and 5, the cam cover 88 is also provided with a fill neck 164 that has a removable cap 166 so that lubricant may be added to the lubrication system of the engine 20 through the fill neck 164. The fill neck 164 is desirably positioned off center on the cam cover 88 at a position above the lower edge of the chamber case 150 of the separator 146. This position allows the lubricant escaping through the opening 162 to drip from the separator 146 without backflowing into the fill neck 164 and escaping from the cam chamber 90 through the fill neck 164. More specifically, the fill neck 164 has an aperture 165 that opens into the cam chamber 90 and is positioned so its lowermost edge lies above a plane defined along the lower edge of the vapor separator 146.

With continued reference to FIGS. 2 and 5, the fuel pump 122 is also preferably positioned off-center on the cam cover 88 and desirably the fuel pump 122 may be positioned generally below the fill neck 164 or below the discharge 162 of the vapor separator 146. As best seen in FIG. 5, the cam cover 88 includes threaded bosses 168 which receive a pair of bolts that secure the fuel pump 122 to the cam cover 88. The cam cover 88 also includes the aperture 126, introduced above, through which the actuator plunger 124 of the fuel pump 122 extends into the cam chamber 90.

Figure 7:
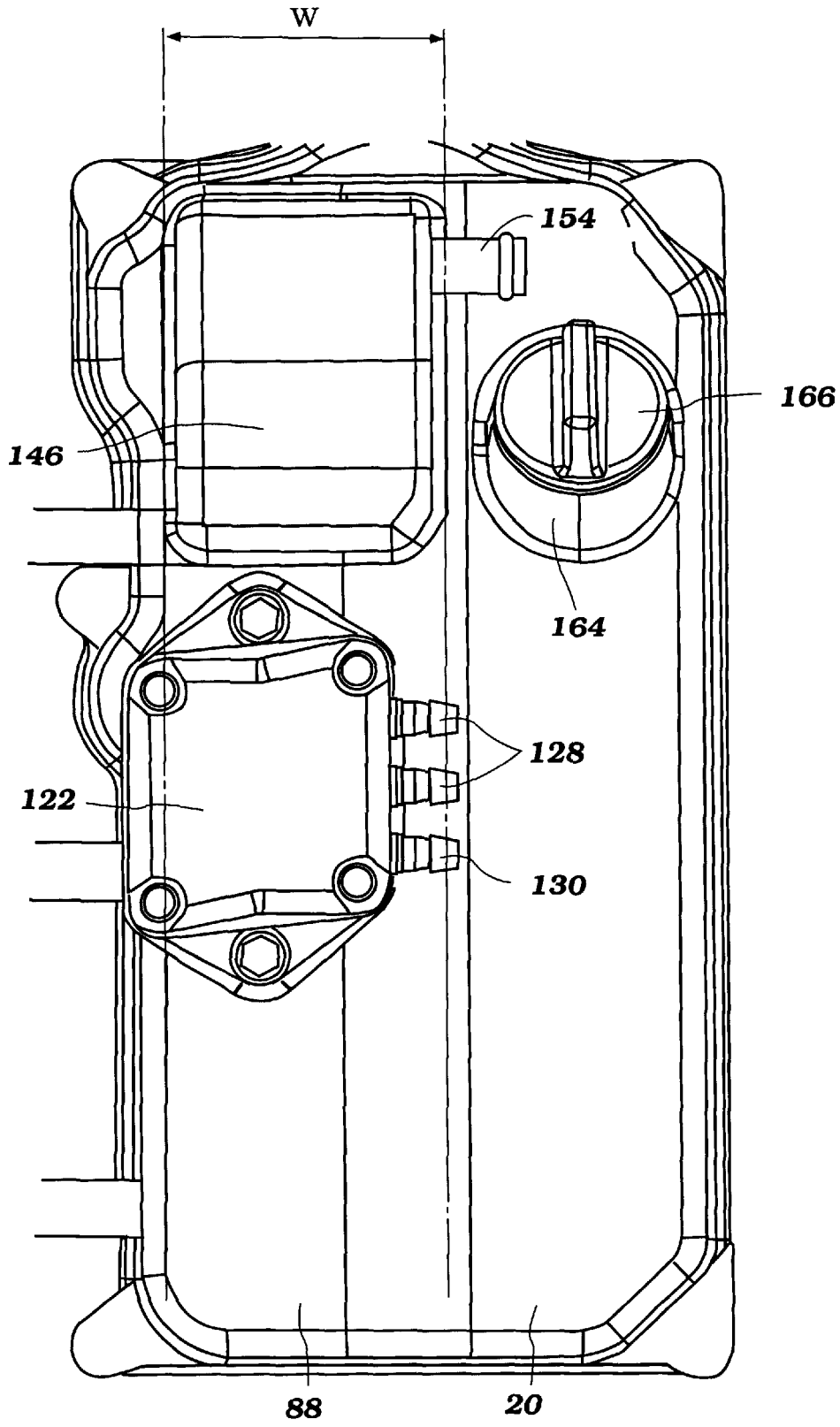
FIG. 7 is a front-end view of a cam cover assembly having certain features, aspects and advantages in accordance with the present invention.

With reference now to FIG. 7, a second embodiment of the present engine component layout is illustrated therein. In this embodiment, the fuel pump 122 is arranged below the vapor separator 126 while the fill neck 164 is arranged to the side of the vapor separator 146. More specifically, the actuating plunger 124 of the fuel pump 122 is positioned within the width W of the vapor separator 146 and, even more specifically, the plunger 124 is desirably located substantially below the opening 162 of the vapor separator 146 through which lubricant is returned to the cam chamber 90. In this manner, the lubricant being returned to the cam chamber 90 through the opening 162 may be used to lubricate the moving components of the actuator plunger 124 and rocker arm tips 86. Moreover, the side-by-side placement of the vapor separator 146 and the fill tube 164 ensures that lubricant dripping through the opening 162 will not backflow through the filter 164 when the cap 166 has been removed.

Figure 8:
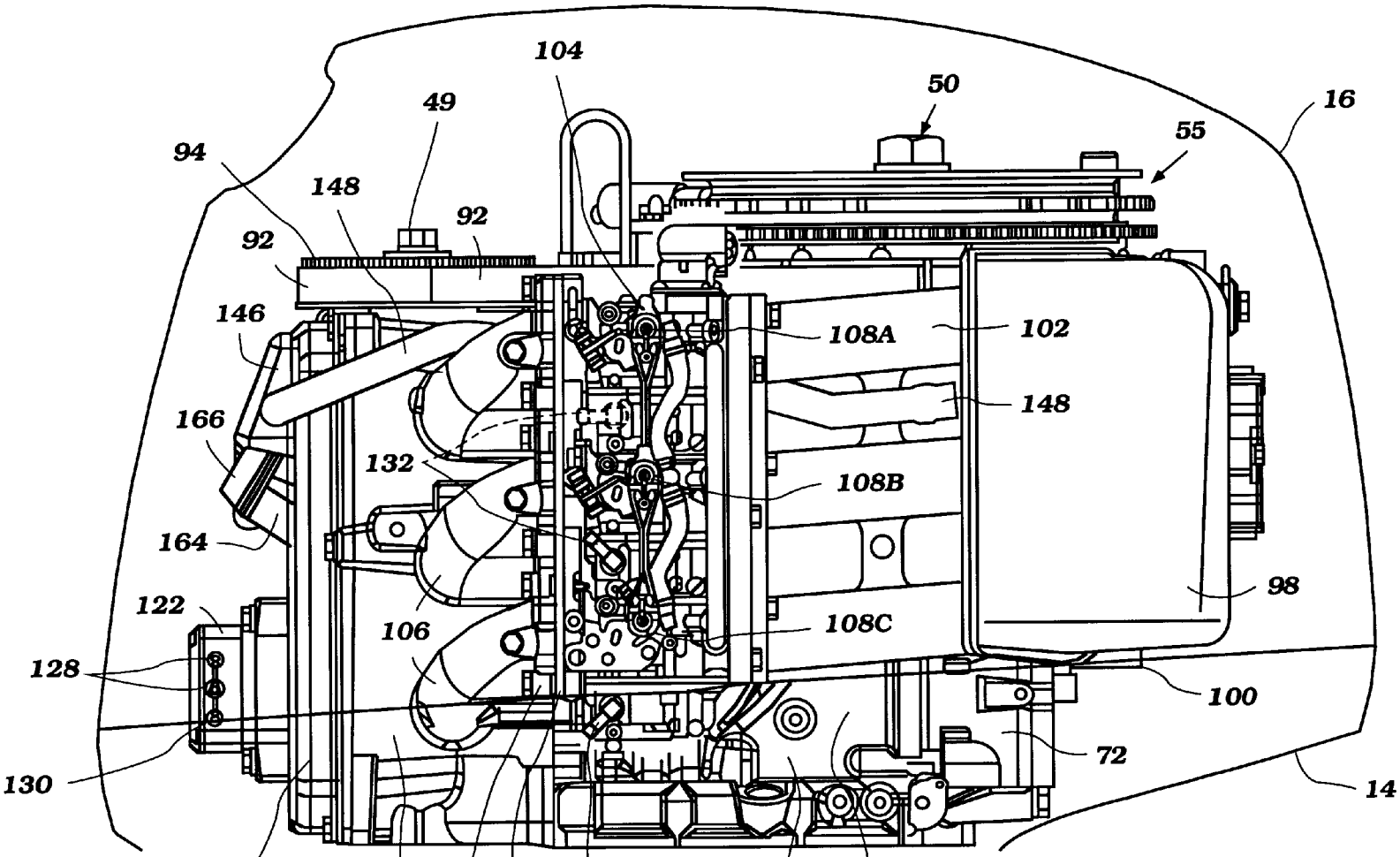
FIG. 8 is a partially sectioned side elevation view of an outboard motor having certain features, aspects and advantages of the present invention.
Figure 9:
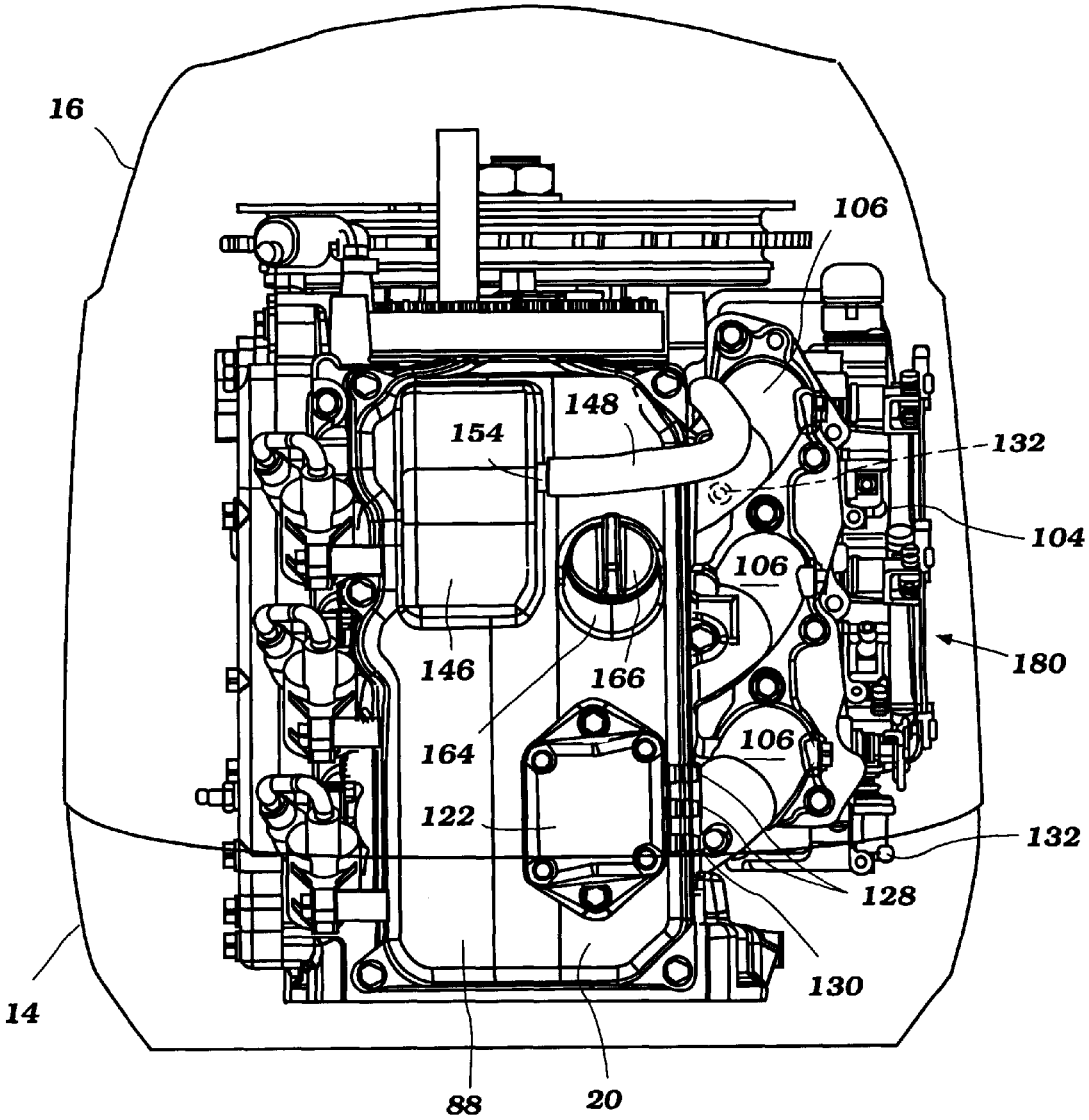
FIG. 9 is a partially sectioned front-end elevation view of the outboard motor of FIG. 8.

With reference now to FIGS. 8 and 9, yet another embodiment of the present engine component layout is illustrated therein. In this embodiment, the uppermost fuel inlet port 132 has been relocated to an internal position relative to the first carburetor 108*a*. Specifically, the upper fuel inlet port has been moved more toward a longitudinally extending center plane extending generally through the cam shaft and the crankshaft 50. Specifically, as shown in FIG. 9 relative to FIG. 3, the upper fuel inlet port 132 has been repositioned to a location closer to the periphery of the cam cover 88 beneath the uppermost intake pipe 106. The relative vertical positioning of the uppermost fuel inlet port 132 remains relatively unchanged, however. Moreover, the lower fuel inlet port 132 has also been relocated to a position generally below the third carburetor 108*c*. The lower fuel inlet port 132 preferably supplies fuel to the third carburetor 108*c* and further to the second carburetor 108*b* through a flow passage that is formed internal to the carburetors and that is not shown in the figures. By relocating the fuel inlet ports 132, the cam arrangement 180 used to operate the carburetors is given increased operating space such that the engine 20 may be configured in a more compact arrangement. Such a compact arrangement is desirable in the field of outboard motors and inboard/outboard motors such that the weight and girth of the motor itself may be reduced and increase the handling performance of the watercraft attached to the motor 10. More specifically, with this arrangement the fuel inlet ports 132 are removed from the region in which the carburetor actuating assembly 180 operates such that the linkage 180 will not be interfered with by the conduits or the ports introducing the fuel into the carburetors 108 themselves.

Although the present invention has been described in terms of certain presently preferred embodiments, other embodiments apparent to those of ordinary skill in the art also are within the scope of this invention. Thus, various changes and modifications may be made without departing from the spirit and scope of the invention. Moreover, not all of the features, aspects and advantages are necessarily required to practice the present invention. Accordingly, the scope of the present invention is intended to be defined only by the claims that follow.

What is claimed is:

1. An engine for an motor, the engine having a cylinder block interposed between a cylinder head and a crankcase, the engine further comprising a cam cover attached to the cylinder head to enclose a cam chamber within the cylinder head, the cam chamber containing a valve operating mechanism, a lubricant vapor separator located on the cam cover outside of the cam chamber, the separator including an upper opening communicating with a separator chamber, the chamber in communication with the cam chamber through at least the upper opening, the separator also including an intermediate opening through which ventilation gases are vented for recirculation through the engine, and a lower opening through which lubricant, separated from the ventilation gases, flows from the vapor chamber into the cam chamber, the cam cover further comprising an oil fill port, the oil fill port including an aperture extending through the cam cover, at least a portion of the aperture positioned to lie at least generally vertically as high as the lower opening of the separator.

2. The engine of claim 1, wherein the entirety of the aperture is positioned to lie generally vertically as high as the lower opening of the separator.

3. The engine of claim 1 further comprising a fuel pump, the fuel pump positioned external to the cam cover and having a portion extending through the cam cover.

4. The engine of claim 3, wherein the portion extending through the cam cover is positioned generally vertically below the lower opening of the separator.

5. The engine of claim 4, wherein at least part of the portion of the fuel pump extending through the cam cover lies directly below the lower opening of the separator.

6. The engine of claim 1 further comprising a fuel pump positioned vertically lower than the oil fill port and the separator.

7. The engine of claim 6, wherein the fuel pump protrudes externally from the cam cover.

8. The engine of claim 6, wherein the fuel pump is mounted to the engine on the cam cover.

9. An outboard motor comprising a cowling, an engine compartment defined within the cowling, an engine mounted in the engine compartment, the engine comprising a cylinder block, a crank cover mounted to a face of the cylinder block and a crankcase defined between the crank cover and the cylinder block, a cylinder head mounted to a face of the cylinder block opposite the crank cover, a cam cover connected to the cylinder head and a cam chamber defined by the cam cover and the cylinder head, at least one cam shaft positioned within the cam chamber, a vapor separator positioned on the cam cover and arranged to protrude from the cam cover generally away from the cam shaft, a fuel pump positioned along the cam cover at a location generally below the vapor separator, a lubricant fill tube positioned on the cam cover to one side of the vapor separator and the tube being positioned at least partially higher on the cam cover than the vapor separator.

10. The outboard motor of claim 9, wherein the fuel pump comprises a piston actuator, the piston actuator extending into the cam chamber and the piston actuator being in operative contact with the cam shaft.

11. The outboard motor of claim 10, wherein the vapor separator has a lubricant outlet, and a point of the operative contact between the piston actuator and the cam shaft is positioned generally below the lubricant outlet.

12. The outboard motor of claim 11, wherein the operative contact receives lubricant from the lubricant outlet.

13. The outboard motor of claim 9, wherein the vapor separator comprises an inlet that extends between a vapor chamber within the vapor separator and the cam chamber and a lubricant outlet positioned at a lower portion of the vapor chamber.

14. The outboard motor of claim 13, wherein the fuel pump is actuated by a rocker arm 78 and actuator shaft 124 driving linkage extending between the cam shaft and the fuel pump.

15. The outboard motor of claim 14, wherein the driving linkage receives lubricant from the lubricant outlet.

16. The outboard motor of claim 9, wherein the lubricant fill tube is positioned entirely higher on the cam cover than the lubricant outlet of the vapor separator.

17. The outboard motor of claim 9, wherein the lubricant fill tube is positioned generally above the fuel pump.

18. The outboard motor of claim 17, wherein the lubricant fill tube also is positioned generally to one side of the fuel pump.

* * * * *

UNITED STATES PATENT AND TRADEMARK OFFICE

CERTIFICATE OF CORRECTION

PATENT NO. : 6,308,695 B1
DATED : October 30, 2001
INVENTOR(S) : Kazuhiko Watanabe It is certified that error appears in the above-identified patent and that said Letters Patent is hereby corrected as shown below:

Column 9,
Line 30, -- outboard -- should be inserted after "for an"

Signed and Sealed this

Seventeenth Day of June, 2003

JAMES E. ROGAN
*Director of the United States Patent and Trademark Office*